US006885342B2

(12) United States Patent
Saegrov et al.

(10) Patent No.: US 6,885,342 B2
(45) Date of Patent: Apr. 26, 2005

(54) ANTENNA FOR TRANSPONDER

(75) Inventors: Atle Saegrov, Trondheim (NO); Geir Vavik, Jonsvatnet (NO)

(73) Assignee: Q-FREE ASA, Trondheim (NO)

( * ) Notice: Subject to any disclaimer, the term of this patent is extended or adjusted under 35 U.S.C. 154(b) by 0 days.

(21) Appl. No.: 10/169,763

(22) PCT Filed: Jan. 15, 2001

(86) PCT No.: PCT/NO01/00013

§ 371 (c)(1),
(2), (4) Date: Aug. 6, 2002

(87) PCT Pub. No.: WO01/59879

PCT Pub. Date: Aug. 16, 2001

(65) Prior Publication Data

US 2003/0117329 A1 Jun. 26, 2003

(30) Foreign Application Priority Data

Feb. 8, 2000 (NO) ..... 20000613

(51) Int. Cl.[7] ..... H01Q 1/38; H01Q 15/24

(52) U.S. Cl. ..... 343/700 MS; 343/756; 343/846

(58) Field of Search ..... 343/700 MS, 756, 343/909, 769, 846

(56) References Cited

U.S. PATENT DOCUMENTS

| | | | | | |
|---|---|---|---|---|---|
| 4,486,758 | A | | 12/1984 | De Ronde | 343/700 MS |
| 5,241,321 | A | | 8/1993 | Tsao | 343/700 MS |
| 5,307,075 | A | | 4/1994 | Huynh | 343/700 MS |
| 5,565,875 | A | | 10/1996 | Buralli et al. | 343/700 MS |
| 5,815,121 | A | * | 9/1998 | Collier | 343/756 |
| 5,874,919 | A | | 2/1999 | Rawnick et al. | 343/700 MS |

FOREIGN PATENT DOCUMENTS

| | | |
|---|---|---|
| GB | 2142475 | 1/1985 |
| WO | 98/50977 | 11/1998 |

* cited by examiner

*Primary Examiner*—James Vannucci
(74) *Attorney, Agent, or Firm*—Dennison, Schultz, Dougherty & MacDonald

(57) ABSTRACT

Antenna for sending and receiving microwave radiation, e.g. for use in a transponder in a transponder system for wireless payment of tolls, or the like. It has an excited antenna element (13) placed on a dielectric antenna carrier or substratum (11), e.g. on a printed circuit board laminate with a copper covered plastic basis suitable for manufacturing of so-called printed circuits. To increase the performance of the antenna for high production rates with cheap materials, the antenna element is placed such that it gets a directional effect mainly perpendicular to a bearing plane (12) of the substratum (11).

9 Claims, 1 Drawing Sheet

ANTENNA FOR TRANSPONDER

BACKGROUND OF THE INVENTION

Figure 1:
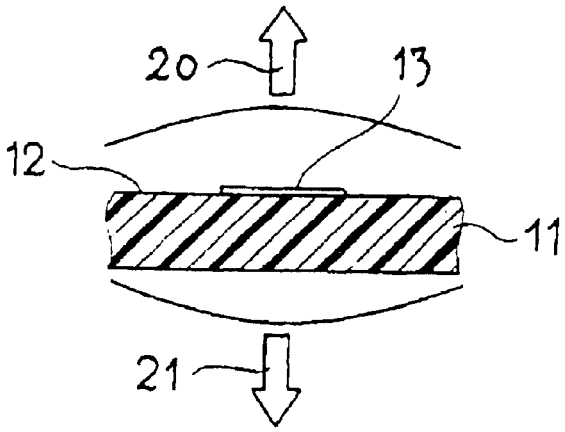

The present invention is connected with transponder systems for wireless payment, e.g. for payment of a toll for vehicles. Q-Free ASA has manufactured such systems for many years. These systems are used in several countries named as the "Q-free box". The expression "box" is related to the transponder element in this system provided in every individual vehicle. The transponder receives data from a device placed near the road, and as an answer it sends individual data back to the road device.

The technological development within this area has in the meantime moved towards active transponders operating with microwave radiation in the area of 5.8 Hz, that is wavelengths in the area of centimeters, which have a battery and an active communication controller. The transponder receives data as amplitude modulated radiation and sends data as phase modulated radiation.

The simplest embodiment of such a transponder is a diode coupled into an antenna, leading to amplitude demodulation by rectifying the carrier wave. By sending, a current is sent alternately in the diode, and its reflection coefficient is thus changing, and accordingly this gives phase modulation. The principle makes it possible to send without use of a local-oscillator on the transponder and it is known as "back-scattering".

Because of the large production rate for such transponders it is a difficult task to make transponder antennas which have little scattering and which may be produced as simple and cheap as possible.

Known antennas which are easy to manufacture are microstrip antennas. These are antennas which are easily realizable on a substratum together with the rest of the circuitry. The problem regarding microstrip antennas is that they are based on resonance where a large e-field concentration along the edge of the antenna element arises towards the earth plane. The effectiveness of the antenna and the resonance frequency are very dependant on the dielectric constant in the substratum and the thickness of the substratum. Accordingly, a usual printed circuit board laminate, such as "FR-4" glass fibre laminate, is not suitable for the production of such antennas. Good microwave laminate based on PTFE (teflon) is the most common in use, but this laminate is expensive, complicated to manufacture and uses few environmentally friendly processes during the manufacturing.

Lately, laminates have become available that are something between glass fibre laminate (FR-4) and PTFE laminate, such as "ROGERS 4300", but still this is not an alternative able to compete with standard laminate.

OBJECT OF THE INVENTION

The main object of the present invention is to make an antenna of the mentioned kind, that despite of good antenna performances still makes them possible to be manufactured using standard laminate (FR-4), which is suitable for frequencies considerable above 20 GHz, also by volume production of such systems.

THE INVENTION

The invention is stated in claim 1, with the new elements being stated in the characterizing part. Further advantageous features of the invention are stated in the claims 2 to 9.

Independent of the details of the structure chosen, this solution has a considerable advantage compared to known antennas where the direction effect for the antenna extends at least substantially transverse to the plate shaped carrier (the substratum). This results in the antenna according to the invention having a higher efficiency factor and antenna gain. Moreover, the resonance frequency of the antenna becomes less dependant on the dielectric of the antenna carrier. High concentrations of electrical field in the dielectric of the antenna carrier, which appear with known antennas, do not appear with antennas according the invention. Together with a carrier having a high dielectric quality, such as PTFE (teflon), it is also possible to use the antenna according to the invention in areas of millimeter waves (30–300 GHz).

The dielectric constant and the dielectric losses of the substratum have little influence on the resonance frequency of the antenna and dielectric losses. This gives little scattering due to volume production and thus it is suitable for products with high production rates.

Another advantage with regard to the antenna according to the present invention is that it is very broad banded, typically 10–20% of the center frequency. Thus, it is very favorable regarding broadband applications.

EXAMPLE

The invention is further described below, with reference to the drawings, where

Figure 2:
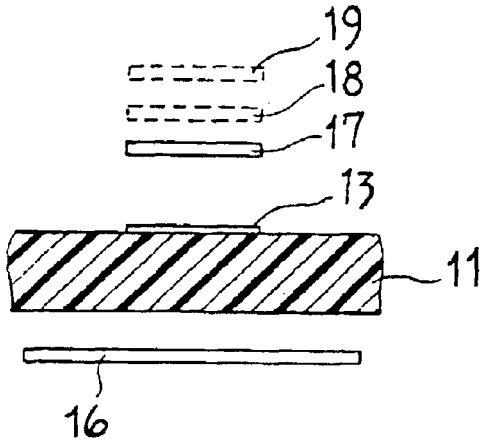
Figure 3:
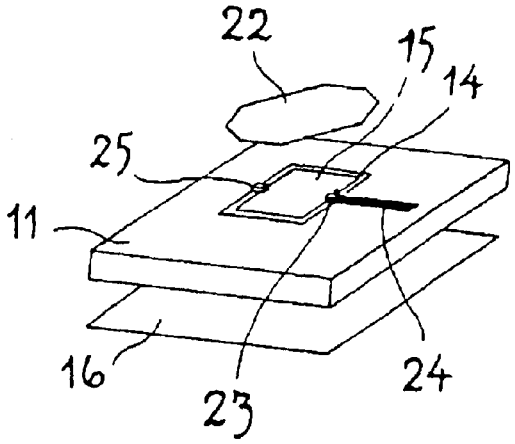

FIG. 1 shows a part of a printed card which supports an antenna element in a side view, FIG. 2 shows the printed card with the antenna element in FIG. 1 together with an additional antenna element which affects the directional effect, and FIG. 3 shows a perspective view of the printed card in FIG. 1 together with an additional antenna element which affects the directional effect of the antenna, together with a polarization transformer for transforming the polarization in the radiation received respectively sent from the antenna element.

FIG. 1 shows a part of a printed card or substratum 11 of a dielectric material, for example of glass fibre laminate "FR-4", which is used to manufacture printed circuits. The printed card 11 may be in a transponder of the kind mentioned in the introduction and has the function of an antenna supporter, which on its bearing surface 12 supports an antenna element 13. The antenna element 13 is connected to a communication controller via an antenna cable (not shown) and is in the present case the excited element in the antenna according to the invention.

The antenna element is in this embodiment made as a Quad antenna, however, as the antenna element not only consists of a simple, quadratic shaped frame, but consists of two frames 14 and 15 (FIG. 3) situated in the same plane, one in the other. The frames 14 and 15 are made of copper tracks (not further described) having a fixed width and height, situated in the plane of the bearing surface 12 of the printed card 11. The individual frame parts in the two frames 14 and 15, which extend in parallel, have a predetermined mutual distance. The circumference of the two frames 14 and 15 may be utilized to achieve a significant directional effect, without additional antenna elements amplifying this effect being necessary, and in size is near the wavelength $\lambda$. The relatively small difference between the size of the circumferences of the two frames 14 and 15 also means that the resonance frequency of these two frame elements are correspondingly different, such that a certain broad band effect is already achieved through this special combination of two Quad antenna elements. This broad band effect may be increased by shaping the two frames 14 and 15 aperiodic.

As an additional antenna element, a reflector 16 is shown in FIGS. 2 and 3, arranged on the opposite side of the printed card 11 compared to the excited antenna element, and having a predetermined distance from this antenna element. Further, FIG. 2 shows examples of parasite elements or directors 17, 18 and 19, whose purpose is to amplify the directional effect of the antenna, extending across the bearing plane 12 according to the Yagu-Uda principle.

The arrows 20 and 21, inclusive of the curves lying above and below in FIG. 1, symbolizes electrical waves schematically, and illustrate the directional effect intended by the antenna according the invention, consequently extending across the printed card 11. The reception and the radiation of the radiation energy in the direction of the arrow 21 is to be suppressed, and instead, the use of a reflector 16 will amplify the radiation in the direction of the arrow 20.

The directional characteristic which is achieved using the described elements and precautions, has the consequence that the dielectric material in the printed card has no influence on the frequency of the antenna any longer, and that losses arising in the dielectric under influence of the antenna are kept low.

FIG. 3 shows a polarizer or polarization transformer 22 placed in front of the substratum 11, while the reflector 16 is placed on the back side. The polarizer serves to transform the linearly polarized microwave radiation radiated from the antenna element 13 to circular polarized waves, and to transform circular polarized waves received to linearly polarized waves respectively.

The mentioned antenna elements, i.e. the antenna element 13, the reflector 16, the parasite elements 17 to 19 and the polarization transformer 22, are preferably radiation connected to each other via air as the dielectric. However, a foam material having a low dielectric constant and low dielectric losses may also be used, as this foam material then operates as a holder for the different antenna elements.

To achieve good performance according to the object of the invention it is important that no high concentration occur in the electric field in the substratum 11. The antenna element therefore becomes a resonator having a relatively low Q-factor, preferable a Q-factor between 5 and 10.

The two branches in the antenna are connected to a coupling capacitor 23 at the connection of the two feeding lines 24. A diode 25 connected between the two frames 14, 15 towards the point of connection serves as a receiver rectifying the carrier wave. The direct voltage component is laid over the coupling capacitor 23 and is led out over the feeding lines 24.

What is claimed is:

1. An antenna for sending and receiving microwave radiation for use in a transponder system for wireless toll payment, comprising:

a dielectric antenna supporter (11) having a bearing surface (12), a frame shaped or loop shaped excited antenna element (13) extending in a first plane disposed on the dielectric antenna supporter bearing surface (12), a polarization transformer (22), wherein the excited antenna element is linearly polarized and disposed at a predetermined distance from the polarization transformer (22) to transform linearly polarized radiation to circular or elliptical polarized radiation, and wherein the polarization transformer (22) operates as a director, a reflector disposed at a predetermined distance from the excited antenna element, at least one parasite element or director placed in a predetermined distance from the excited antenna element, wherein the frame or loop antenna comprises two substantially equal shaped frames or loops placed at a predetermined distance, and a diode (25) connected to the frames or loops (14, 15) for demodulation, and a capacitor (23) connected to the frames or loops (14, 15).

2. Antenna according to claim 1, wherein at least one additional antenna element assigned to the excited antenna element (13) is selected from the group consisting of a reflector, directors, and a polarization transformer, and is radiatively connected to the excited antenna element (13) via a medium having a constant and low dielectric losses, to give the lowest relative dielectric rate possible.

3. Antenna according to claim 1, wherein the excited antenna element (13) and/or at least one additional antenna element selected from the group consisting of a reflector, directors and a polarization transformer are arranged with strip-line technology on a thin plastic film, said thin plastic film being held in a predetermined distance from the bearing plane (12) of the dielectric antenna supporter (11).

4. Antenna according to claim 1, wherein the antenna capacity or resistance is increased to achieve a low Q-factor of 5–10.

5. Antenna according to claim 1, wherein the reflector (16) is a metallic plate.

6. Antenna according to claim 5, wherein said polarization transformer (22) is octagonally shaped metallic plate.

7. Antenna according to claim 6, wherein the frame or loop antenna is shaped as a Quad antenna having one or more quadratic frames or loops (14, 15).

8. Antenna according to claim 6, wherein the frame or loop antenna is shaped with one or more ring-shaped, elliptical or polygonal frames or loops.

9. Antenna according to claim 1, wherein the circumference of the frames or the loops is in the size of the wavelength (λ) of the received and respectively sent microwave radiation.

* * * * *